United States Patent [19]

Fraynd

[11] Patent Number: 4,817,320

[45] Date of Patent: Apr. 4, 1989

[54] SHOPPER'S REMINDER SYSTEM

[75] Inventor: Linda S. Fraynd, Miami, Fla.

[73] Assignee: Ad-Aptations Inc., Miami, Fla.

[21] Appl. No.: 66,385

[22] Filed: Jun. 25, 1987

[51] Int. Cl.[4] ..... G09F 7/04

[52] U.S. Cl. ..... 40/621

[58] Field of Search ..... 40/426, 600, 621, 19.5; 283/55

[56] References Cited

U.S. PATENT DOCUMENTS

| | | | |
|---|---|---|---|
| 3,156,056 | 11/1964 | Pribil | 40/621 |
| 3,716,935 | 2/1973 | Frederichs | 40/621 |
| 3,769,720 | 11/1973 | Terrones | 40/621 |

FOREIGN PATENT DOCUMENTS

| | | | |
|---|---|---|---|
| 2160000 | 12/1985 | United Kingdom | 40/600 |

*Primary Examiner*—John J. Wilson
*Assistant Examiner*—Cary E. Stone
*Attorney, Agent, or Firm*—John Cyril Malloy

[57] ABSTRACT

A system primarily designed to be used as a household reminder system for the replenishment of household items, including food supplies, having two display surfaces, one of which is provided for categories of products existing in the household in adequate supply, and the other being indicative of items requiring replenishment. A plurality of indicator elements, each specifically including an indicia formed thereon, are transferable between the two display surfaces, thereby serving as a visual reminder when certain household items need be replenished. The subject system is adaptable to industrial and/or business needs and is not limited to household or domestic application.

5 Claims, 2 Drawing Sheets

SHOPPER'S REMINDER SYSTEM

BACKGROUND OF THE INVENTION

1. Field of the Invention

This invention relates to a reminder system primarily but not exclusively designed to be used in a domestic environment to remind a housewife or other personnel when certain food supplies or domestic products need to be replenished through the pictorial presentation of food or product categories being removably disposed at a location indicative of adequate supply, or alternately, inadequate supply.

2. Description of the Prior Art

Typically in the conventional household, common supplies such as food products, cleaning goods, etc. are replenished on a periodic basis when the person responsible visits the local supermarket or like facility. Also, it is common practice for the responsible person to make out "grocery lists" in order to determine what products or goods are required. The accuracy of such an inventory is, of course, important in order that certain goods or products not be inadvertently deleted from the needs of a given household.

It is of course recognized that the compilation of such lists is tedious, time consuming and frequently less than efficient since it is easy to overlook many goods or products which are not frequently used without some type of reminder being given to the responsible party compiling the aforementioned list.

While accurate and adequate inventory replenishment is a convenience in the proper functioning of a household, it frequently is an absolute necessity in the efficient and economical operation of certain businesses. Therefore, both domestically and industrially there is an obvious need in the prior art for some type of reminder system which efficiently informs the responsible party or parties that a given category of product need be replenished. While inventory control of the type set forth above has long been a recognized need in many businesses, there has been relatively little development for a similar type of reminder or inventory system utilized in the household.

Reminder or "scheduling" devices exist in the prior art in an attempt to overcome many of the problems as set forth above. Such devices are represented in the U.S. Pat. Nos. 3,224,128; to Steward; Dean et al., 3,839,130; and Steward, 3,670,435. The above-set forth patents relate primarily to scheduling devices, but do show the broad concept of magnetic or equivalently structured indicator elements mounted on some type of display face which is categorized to present a means of adequately controlling work flow, scheduling, inventory, etc.

While operable for their intended functions, certain prior art devices generally of the type shown in the aforementioned patent, still suffer from an inherent problem generally associated with the manual compilation of information, primarily because there is generally not sufficient pictorial representation to serve as an immediate reminder of a given category of products. The structural components generally common in control or scheduling devices in the prior art are "non-pictorial" or not specifically representative of the category of goods or products represented.

Accordingly, there is a need for a reminder system capable of not only clearly indicating the relative status of the supply of a given category of goods or products, but also which may serve as a reminder of a given category itself, thereby eliminating the necessity of taking a physical inventory of the various goods or products commonly replenished on a periodic basis.

SUMMARY OF THE INVENTION

This invention relates to a reminder system designed to be used for the survey and replenishment of household goods, including food products, cleaning supplies, and like products commonly used around the house. However, while a description of the features of the present invention will be primarily directed to use in a domestic environment, it should be emphasized herein that the system of the present invention is readily adaptable for industrial or business use for the control and regulation of inventory supply.

The system of the present invention incorporates two separate display surfaces each mounted on a separate base, preferably separable from one another, and further, preferably capable of being mounted in a readily observable location, such as on a vertically oriented support wall or the like. To accomplish this, proper mounting means are secured to each of the bases so as to attach the bases in a manner which will readily expose, for viewing, the aforementioned display surfaces. Further, a title or labeling section is included on each of the bases so as to adequately "identify" each of the display surfaces in terms of a meaningful label or the like being indicative of an adequate supply and an inadequate supply, such as when products need replenishing.

Each of the products may be divided into a plurality of compartments or sections generally segregated from one another so as to effectively separate categories of goods or products being controlled. Such segregation may be considered only in a general sense and provided primarily so as to not inadvertently confuse one category of goods with another when such categories are represented by indicator means.

The indicator means referred to herein comprises a plurality of indicator elements each specifically structured in cooperative relation with the display surfaces so as to be removably mounted thereon, and therefore, capable of being transferred from one display face to another. Such transfer, as set forth above, is indicative of a change in status of the supply of inventory of the given product between, for example, an adequate supply and an inadequate supply. The latter condition, of course, serves as a reminder that the goods or products need be replenished. Each of the indicator elements comprises a connecting structure which may be a magnetic element preferably secured to the underportion of the indicator element and attachable to each of the display faces by virtue of such display faces being formed from a magnetically attractable material such as metal or the like. Further, the connector means are disposed so as to mount each of the indicator elements on either of the display faces in a manner which will readily expose, for viewing, the outer portion and any indicia means mounted thereon. As will be explained in greater detail hereinafter, such indicia means have a number of different embodiments, including a plurality of indicator elements having a pictorial display and/or a 3-dimensional replication of a given category of goods, such as fish, fruit, cheese, bread, etc. This may well be considered more efficient than actually defining the indicia means as a word, which, in certain instances, may be readily overlooked. In addition, such pictorial representations defining the aforementioned indicia means also serve as a mental reminder, when viewed by the responsible party, as to whether or not the category of goods or products represented have recently or frequently been used.

The invention accordingly comprises the combination of elements and arrangement of parts which will be exemplified in the structure hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 3:
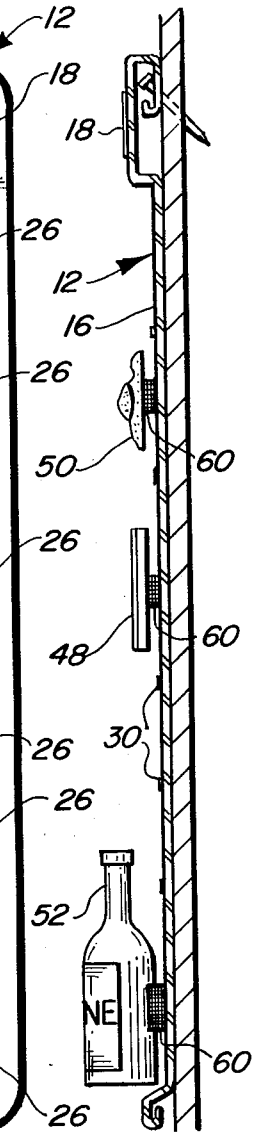
FIG. 3 is a sectional view along line 3—3 of FIG. 2.

The present invention relates to a system designed to serve primarily as a pictorial reminder of the status of the inventory of a plurality of categories of products, goods, etc. The components of the present invention are disclosed in the drawings, to be described in greater detail hereinafter, primarily in the environment of a domestic or household application. However, it should be emphasized that any type of inventory control, including industrial, business, etc. can be regulated through adaptation of the system of the present invention and the various components to be set forth hereinafter.

Figure 2:
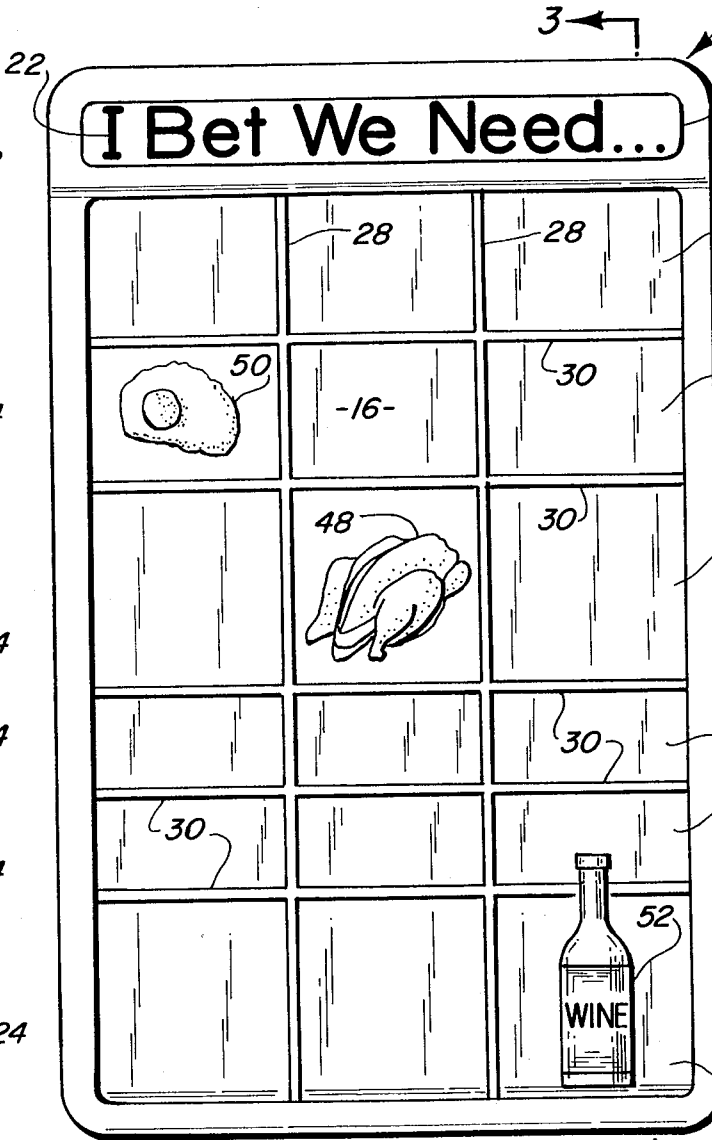
FIG. 2 is a front plan view of a second base and accompanying display face of the present invention used in cooperation with the structure of FIG. 1.
Figure 1:
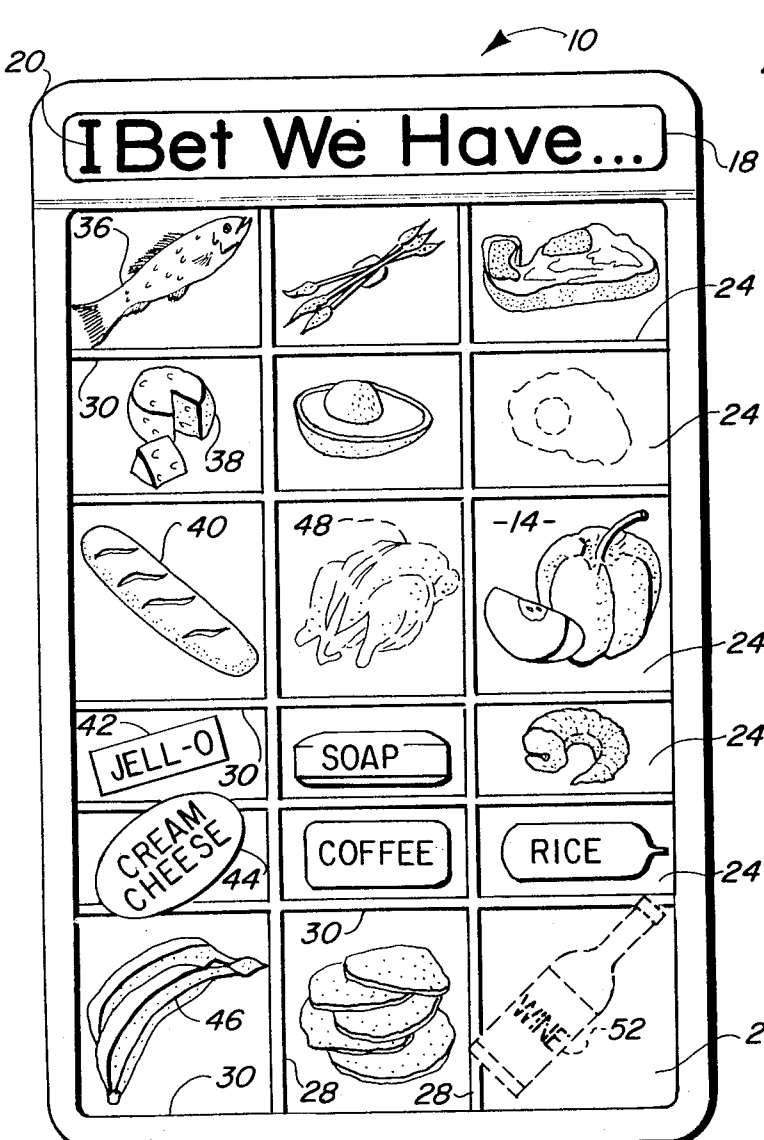
FIG. 1 is a front plan view of one base and accompanying display face of the present invention.
Figure 4:
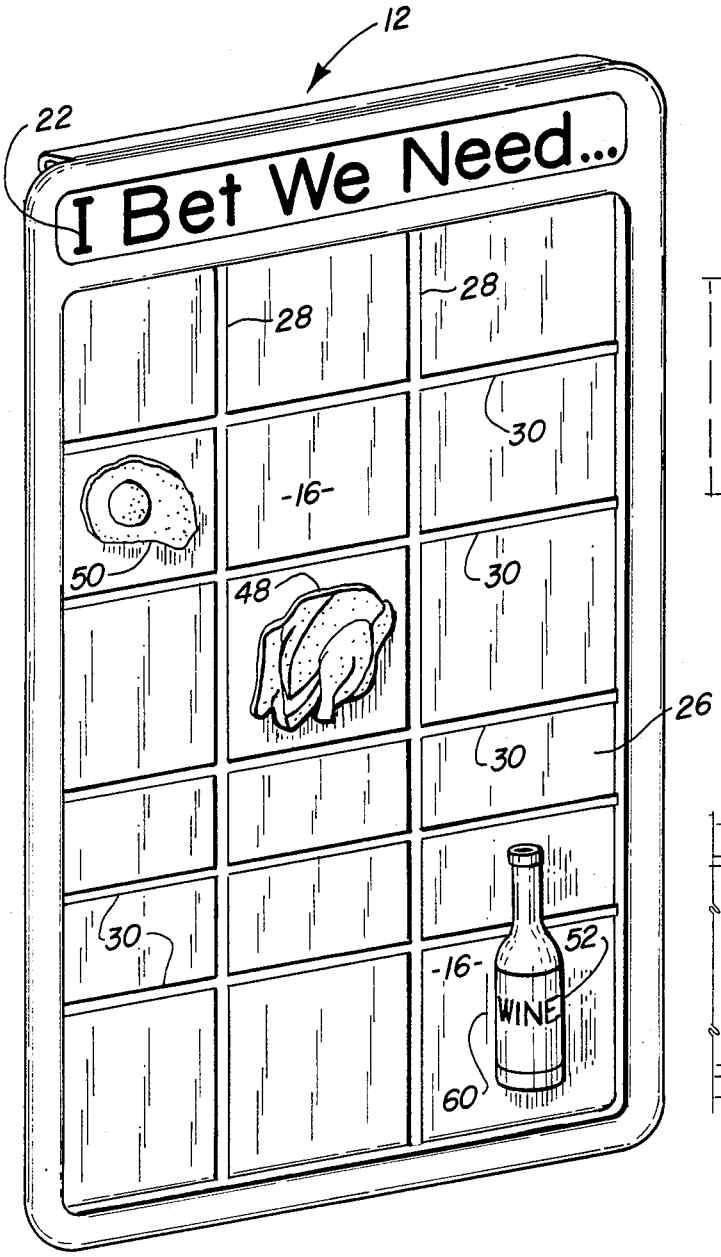
FIG. 4 is a perspective view of one of the embodiments of FIGS. 1 and 2, showing the relative position of the display face relative to the base.
Figure 5:
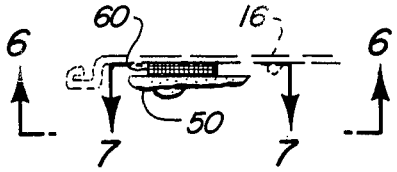
FIG. 5 is a top detailed view of an indicator element associated with one or both of the aforementioned display faces of FIGS. 1 and 2.
Figure 6:
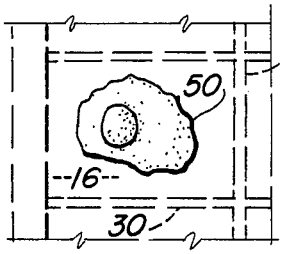
FIG. 6 is a front detailed view of the embodiment of FIG. 5 along line 6—6 thereof.
Figure 7:
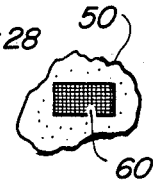
FIG. 7 is a rear view along line 7—7 of FIG. 5 in partial cut-away.
Figure 8:
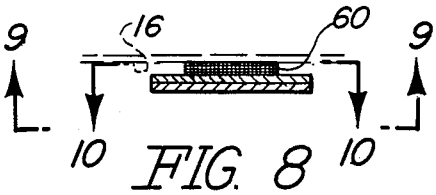
FIG. 8 is a sectional view in detail and partial cut-away of the indicator element shown in FIG. 9.
Figure 9:
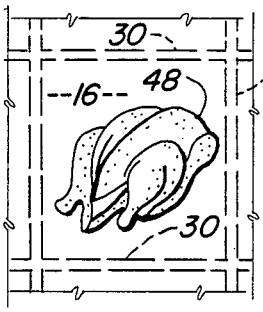
FIG. 9 is a front view along line 9—9 of FIG. 8 in partial cut-away.
Figure 10:
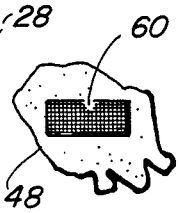
FIG. 10 is a rear view along line 10—10 of FIG. 8 in partial cut-away.
Figure 11:
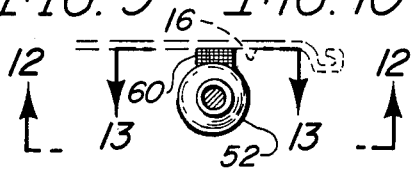
FIG. 11 is a top view in partial cut-away of the embodiment of FIG. 12.
Figure 12:
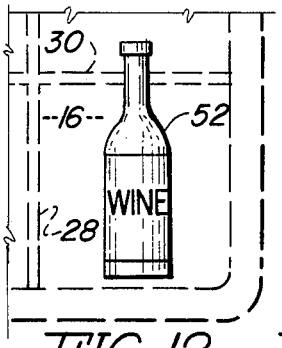
FIG. 12 is a front plan view in partial cut-away along line 12—12 of FIG. 11.
Figure 13:
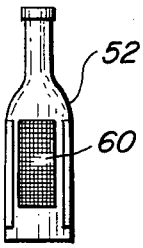
FIG. 13 is a rear view along line 13—13 of FIG. 11.

The system of the present invention comprises, as shown in FIGS. 1, 2 and 4, a first base 10 and a second base 12 preferably of integral one-piece construction having a first and second exposed display face 14 and 16 integrally formed thereon. Each of the bases 10 and 12 include a labeling or title portion 18 having proper titling or information 20 and 22 formed thereon. Such information 20 and 22 may represent and generally classify the respective display faces 14 and 16 as being representative of an adequate supply as in "I BET WE HAVE" and an inadequate supply as in "I BET WE NEED."

Further, each of the display faces 14 and 16 are divided into a plurality of compartments 24 and 26 which may vary in dimension, but are provided generally to segregate the various categories of goods or products being controlled. Such compartments 24 and 26 are defined by a plurality of lines including a first number of lines 28 and a second number of lines 30. As shown clearly in FIGS. 1 and 2, the various first number of lines 28 are disposed in parallel, spaced apart relation to one another, and generally extend parallel to the longitudinal axis of the respective base on which they are mounted. Similarly, the second number of lines 30 are also disposed in spaced, parallel relation to one another, but in transverse relation to the longitudinal axis of the respective base on which they are mounted, and the first number of lines 28. The lines 28 and 30 may be integrally formed such as being painted on the respective display surfaces 14 and 16. Alternatively, taped strips may form the lines so as to allow those various lines to be removed and/or rearranged, for instance, when it is desired to add or detract from the number of compartments 24 and 26 provided. It should further be emphasized that segregation of the compartments from one another is considered to be only generally accomplished to avoid confusion in the accumulation of a plurality of indicator elements, to be described in greater detail hereinafter, since it is readily apparent that such indicator elements can be easily moved or positioned over or across such lines.

An important feature of the present invention is the existence of indicator means which represent the various categories of products or goods being controlled. Such indicator means comprises a plurality of indicator elements represented in FIGS. 1, 2 and 4, on the display surface and shown in detail in FIGS. 5 through 13. The indicator elements are capable of being mounted on either of the display faces. An exposed or outer portion of each indicator element includes indicia means (see FIG. 4) wherein the indicia means may be defined by a pictorial display and/or a 3-dimensioned miniature replica of the particular category of goods involved. For example, indicator element 36 includes as its indicia means a fish, which is provided to pictorially represent and remind a responsible party that the products or goods being controlled include the food product fish. Similarly, indicator elements 38, 40, 42, 44, 46, 48, 50 and 52 are respectively representative of cheese, bread, jello, cream cheese, bananas chicken, eggs and wine. In addition, and as a further example, the indicia means disposed on the exposed viewable face of indicator elements 50 and 52 are 3-dimensional miniature replicas of the product, or more specifically, a category of products represented, such as eggs and wine, respectively. (See FIGS. 5 through 13.) Indicator elements 42 and 44 may represent packaging with adequate informational labels since the product itself may not be easily represented from a pictorial standpoint.

With reference primarily to FIGS. 3 and 5 through 13, the present invention further includes connecting means in the form of a plurality of connecting elements 60 attached to the underportion of each of the indicator elements as shown. In a preferred embodiment, each of the connecting elements 60, are in the form of a magnetic member removably mountable to each of the display surfaces 14 and 16 by virtue of such surfaces being made from a magnetically attractable material such as metal.

In operation, a responsible party merely views the first display surface 14 and the plurality of categories of inventory represented thereon by the indicia means of the respective indicator elements 36 through 52, for example. When a determination is made that a particular category of products or goods needs replenishment, the representative indicator element as at 48, 50 and/or 52 is transferred from the first display surface 14 identified as "I BET WE HAVE" to the second display surface 16 identified as "I BET WE NEED."

Further, at the time of replenishment, such as when the responsible person goes shopping, or the like, the various indicator elements 48, 50, 52, etc. can merely be removed from the second display surface 16 and accumulated in a pouch, bag or like storage device (not shown for purposes of clarity) and taken to the store. This eliminates the need for preparing a detailed list since, while at the store the shopper can just refer to the indicator elements collected from the second display face 16.

Upon return from the store, the shopper may then place all of the indicator elements back in an exposed position on the first display surface 14 indicating that the existing supply is adequate for all of the categories represented.

Now that the invention has been described,

What is claimed is:

1. A reminder system for replacing household food items or like inventory, said system comprising:

a. a first base and a second base used in combination with one another and respectively including a first display surface integrally formed on said first base and a second display surface integrally formed on said second base, both said first and second display surfaces having a substantially planar configuration, b. a mounting means formed on each of said first and second bases and extending outwardly therefrom for attachment of said first and second base in adjacent, communicating relation to one another on a supporting surface, c. each of said first and second display surfaces formed of a magnetically attractable material and each comprising a dividing means formed thereon and disposed and structured to define a plurality of compartments on each of said first and second display surfaces, d. said dividing means comprising a plurality of lines, a first number of which are parallel and spaced from one another and disposed in parallel relation to a longitudinal axis of each display surface, and a second number of said plurality of lines spaced apart in parallel relation to one another and disposed in transverse relation to said first number of lines, e. indicator means for visually representing a plurality of different categories of inventory and comprising a plurality of indicator elements, f. indicia means for identifying individual ones of said plurality of categories formed on each of said indicator elements and disposed in an exposed, viewable position when said indicator elements are mounted on either of said first or second display surfaces, g. at least some of said plurality of indicator elements each comprise said indicia means being defined by a pictorial representation of one of a plurality of categories and each of said pictorial representations comprising a miniature, three-dimensional replica of one category of inventory, h. connector means secured to each of said plurality of indicator elements for attachment thereof to either of said first or second display surfaces and comprising a magnetic member secured to each of said indicator elements and disposed for removable, magnetic attraction to either of said first and second display faces, i. said first and second bases each further including a title portion formed thereon in spaced relation to respective ones of said first and second display surfaces and each title portion including informative labeling means thereon for identifying each of said first and second display surfaces as being indicative of needed inventory or not needed inventory, j. disposition of any of said indicator elements on one of said display surfaces being indicative of inadequate inventory supply of an indicated category of inventory and positioning of any of said display elements on the other of said display surfaces being indicative of an inadequate inventory supply of an indicated category, and k. transfer of any of said indicator elements to the other of said display surfaces being indicative of a current status of inventory supply of a given category of inventory.

2. A system as in claim 1 wherein said magnetic member is secured to an underportion of each of said indicator elements and is disposed to position said indicia means in a viewable position when mounted on either display surface.

3. An assembly as in claim 1 wherein said compartments are of unequal dimensions.

4. A system as in claim 1 wherein said plurality of lines are permanently formed on each of said display surfaces.

5. A system as in claim 1 wherein said plurality of lines are removably secured to respective ones of said first and second display faces.

* * * * *